United States Patent [19]

Ladusaw

[11] 4,373,352

[45] Feb. 15, 1983

[54] VARIABLE DISPLACEMENT COMPRESSOR

[75] Inventor: William T. Ladusaw, Louisville, Ky.

[73] Assignee: General Electric Company, Louisville, Ky.

[21] Appl. No.: 258,188

[22] Filed: Apr. 27, 1981

[51] Int. Cl.[3] ..... F25B 41/00; F04B 49/02

[52] U.S. Cl. ..... 62/196 C; 417/283; 417/310

[58] Field of Search ..... 417/310, 283, 300, 902; 62/196 C

[56] References Cited

U.S. PATENT DOCUMENTS

| | | | |
|---|---|---|---|
| 2,109,970 | 3/1938 | Grisell | 417/310 |
| 2,904,973 | 9/1959 | Kosfeld | 62/324.6 |
| 2,991,931 | 7/1961 | Galin | 418/63 |
| 3,023,590 | 3/1962 | Playle | 62/196 R |
| 3,671,143 | 6/1972 | Clark | 417/310 |
| 4,253,803 | 3/1981 | Wormmeester et al. | 417/283 |

*Primary Examiner*—Richard E. Gluck
*Assistant Examiner*—Timothy S. Thorpe
*Attorney, Agent, or Firm*—Frank P. Giacalone; Radford M. Reams

[57] ABSTRACT

A modulating system for a rotary hermetic compressor is provided with a valve operable by a force varying with the difference in pressure between the suction and discharge pressure for allowing a portion of the refrigerant gas being compressed to travel from the compression side of the roller to the suction side of the roller when the design peak load of the compressor is exceeded.

11 Claims, 7 Drawing Figures

VARIABLE DISPLACEMENT COMPRESSOR

BACKGROUND OF THE INVENTION

In many uses of refrigerant compressors, it is desirable to be able to reduce the capacity or volume of displacement of the compressor under certain operating conditions. Generally, the compressor motor is designed for a maximum peak load and operation of the compressor above design loads can cause motor and/or bearing damage. In many instances compressors are equipped with motor protection devices that are designed to terminate compressor motor operation when abnormal operating conditions are encountered. In most instances, refrigeration system compressors employed in cooling enclosures are designed to function efficiently within certain ambient outdoor temperatures. The peak load increases as the condenser temperature rises as in the case when ambient outdoor temperatures are above the design range, in which case the condenser which is located in the outdoor ambient loses its ability to dispel heat and, accordingly, a high lead pressure exists in the refrigerant discharged thereto. It should be noted that each time motor operation is terminated, the air conditioning process stops including dehumidification. When termination of the system is affected by a motor protection device, the system may be off for several minutes and may then make several attempts to start before continuous operation begins. This cycling of the compressor results in the temperature and humidity level of the air being conditioned to be out of the selected comfort level.

If the compressor continues to operate at above design peak load, the compressor bearing damage may occur, however, it would be advantageous to keep the compressor operating during those periods of extreme outdoor temperatures even at less than normal efficiency which, in many instances, will maintain a desired comfort level by providing some degree of cooling and dehumidification of indoor air.

SUMMARY OF THE INVENTION

It is a general object of the present invention to provide a rotary compressor of the stationary vane type with improved capacity modulating means for controlling the full and partial capacity operation of the compressor.

Another object of this invention is to provide a valve arrangement including means for automatically limiting the load on the compressor.

In accordance with the preferred embodiment of the invention, a hermetic rotary refrigerant compressor for use in a refrigeration system including refrigerant condensing means for condensing high pressure gaseous refrigerant from the compressor, an expansion device, and evaporator means wherein liquid refrigerant vaporizes and absorbs heat of evaporization. The rotary compressor comprises a hermetic casing adapted to contain a high pressure refrigerant gas. Positioned in the casing is a rotary compressor including a cylindrical wall member and upper and lower end plates defining an annular compression cylinder, having spaced suction and discharge ports communicating with the cylinder. A roller is eccentrically rotatable within the cylinder with its peripheral surface arranged to move progressively into sealing relation with successive portions of the cylindrical wall of the annular cylinder. The cylinder is divided into a low and high pressure side by a vane slidably maintained in a slot in the wall member between the ports. A pressure relief means is provided that includes a channel means having a portion thereof communicating with a segment of the cylindrical wall in the lower pressure side of the cylinder.

Arranged in the channel is a valve means including actuating means responsive to discharged refrigerant pressure in the casing. The valve is operable by a force varying with the difference in pressure between the suction and discharge pressures for allowing a portion of the refrigerant being compressed in the cylinder to flow from the compression side of the peripheral surface of the rotor through the channel means to the suction side of the peripheral surface of the roller when the pressure of refrigerant being compressed in the compression side of the rotor is greater than a predetermined pressure so that refrigerant pressure at the discharge port is maintained within the predetermined pressure.

DESCRIPTION OF THE PREFERRED EMBODIMENT

Figure 1:
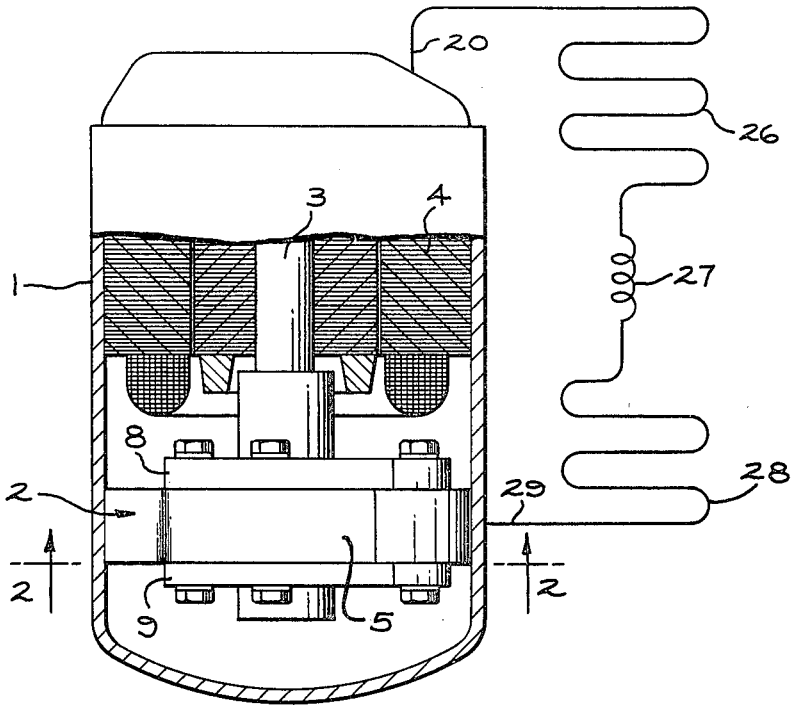
FIG. 1 is an elevational view, partly in section, of a hermetic compressor incorporating one form of the present invention.
Figure 2:
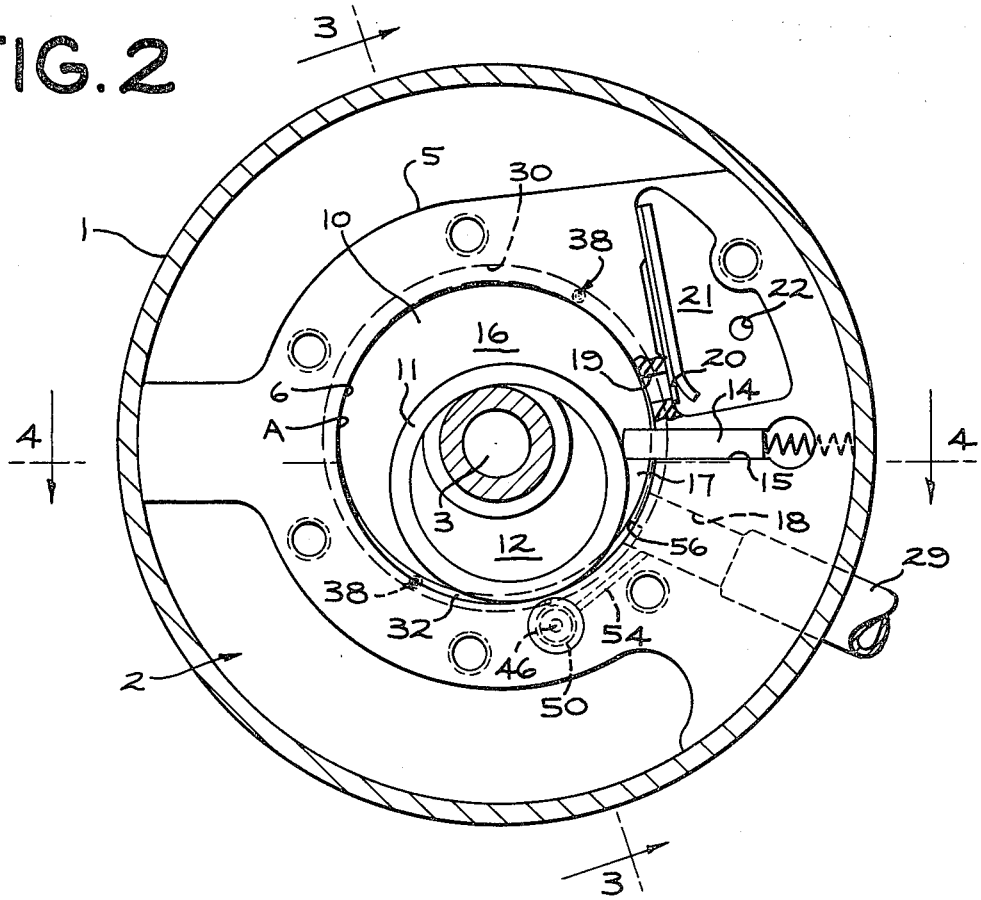
FIG. 2 is a sectional view taken along lines 2—2 of FIG. 1.

With reference to FIGS. 1 and 2 of the drawing, there is shown a hermetic compressor comprising a casing 1 in which there is disposed a rotary compressor unit 2 connected by means of a drive shaft 3 to an electric motor 4. The compressor includes a cylinder block 5 having an inner cylindrical wall or surface 6 which, in combination with upper and lower end plates 8 and 9, defines an annular compression chamber or cylinder 10. A rotor or roller 11 driven by and rotatable on an eccentric 12 on the shaft 3 is contained within the cylinder compression chamber 10. A vane 14 is slidably disposed within a radial slot 15 in the cylinder wall 6 and is adapted to engage the periphery of the rotor 11 to divide the cylinder into a high pressure side 16 and a low pressure side 17.

A low pressure or suction port 18 communicates with the cylinder on the low pressure side 17 of the vane 14 and an outlet or discharge port 19 communicates with the high pressure side 16 of the cylinder on the opposite side of the vane. The discharge port 19 includes a discharge valve 20 for assuring proper compression of the gases issuing through the discharge port and for preventing reverse flow of discharge gases back into the compression cylinder. The discharge gas entering the valve chamber 21 passes through a passage 22 in the upper plate 8 into the upper portion of the case 1. A compressor of this type is adapted to be connected into a refrigeration system as shown, for example, schematically in FIG. 1.

Such a system, in addition to the compressor, includes a condenser 26, a capillary flow restrictor 27 and an evaporator 28. Low pressure refrigerant is withdrawn from the evaporator 28 through a suction line 29 connected to the suction port 18 and high pressure refrigerant is discharged from the compressor case 1 through a discharge line 20 to the condenser. As the compressor shaft eccentric 12 rotates, in a clockwise direction as viewed in FIG. 2 of the drawing, low pressure refrigerant is drawn into the cylinder through the suction port 18, is compressed by rotation of the rotor and the compressed refrigerant is discharged through the discharge passage 19.

It will be seen that the maximum volume displacement of this type of compressor occurs at a time during the cycle of rotation of the rotor when the periphery of the rotor engaging the cylinder wall progresses just beyond the suction port 18. At this point, the maximum volume of gas has been drawn into the cylinder and the suction port sealed by the rotor for compression of the gas during the remaining portion of the rotor cycle.

For the purpose of decreasing the volume of gas compressed by the rotor during each cycle or for automatically controlling pressure of the refrigerant at the discharge port when the discharge gas pressures are above the peak design load, valve means are provided.

The present invention is directed to an improved valve or pressure relief means for modulating the refrigerant gas in the cylinder between the compression side of the rotor to the suction side of the rotor during those times when the discharge pressure exceeds the peak design load of the compressor. Referring now to FIG. 2–5 of the drawings, the modulating means includes an annular groove or channel 30 formed in the upper plate 8. The channel 30 is substantially circular and is dimensioned and arranged so that a portion of the inner circumferentially disposed edge of the channel in the area substantially between the vane 14 and a point A on the cylinder wall 6 diametrically opposite therefrom on the suction side of the vane is exposed to or in communication with the cylinder compression chamber 10. This exposed portion of channel 30 as will be explained fully hereinafter forms a passageway 32 (FIG. 2) which allows refrigerant gas to travel from the compression side of rotor 11 to the suction side of the rotor 11 for modulating the pressure in cylinder 10. In effect, as the periphery of the rotor 11 tangent with the wall 6 progresses clockwise from vane 14 as viewed in FIG. 2, the compression side of the roller is in communication with the suction side of the roller through the passageway 32 provided by the channel 30 when in the reduced capacity mode.

Under normal operating pressure conditions, this passage 32 for refrigerant is closed by a ring valve 36. The valve 36 is substantially a flat washer-like ring which has a radial dimension that fills the channel 30 while allowing axial movement of the valve relative to the channel. As will be explained later, the lower wall or surface of valve 36 is maintained flush with the surface of upper plate 8 facing the cylinder chamber to effectively seal the passageway 32 from the cylinder 10. The ring valve 36 is maintained in its sealing position by a plurality of valve positioning pistons or pins 38. The pins 38 are slidably arranged in corresponding passageways 31 in plate 8. The pins 38 include an enlarged end 40 located in the channel 30 above the ring valve 36 and a body portion 42 extending through the plate 8 to a position in communication with the interior of the casing 1. This arrangement causes the normally high refrigerant pressure in the casing acting on the free end of pins 38 to bias the valve to a position wherein the lower wall of the valve is flush with or in the same plane as the lower wall of plate 8 to maintain the valve in its down position to seal passageway 32 from the cylinder 10 and, thus insure that the cylinder 10 is maintained at its normal design volume or displacement. While in the present instance two diametrically arranged pins 38 are provided for maintaining valve 36 in its down sealing position, it should be understood that other numbers of pins may be employed to accomplish this result.

Figure 3:
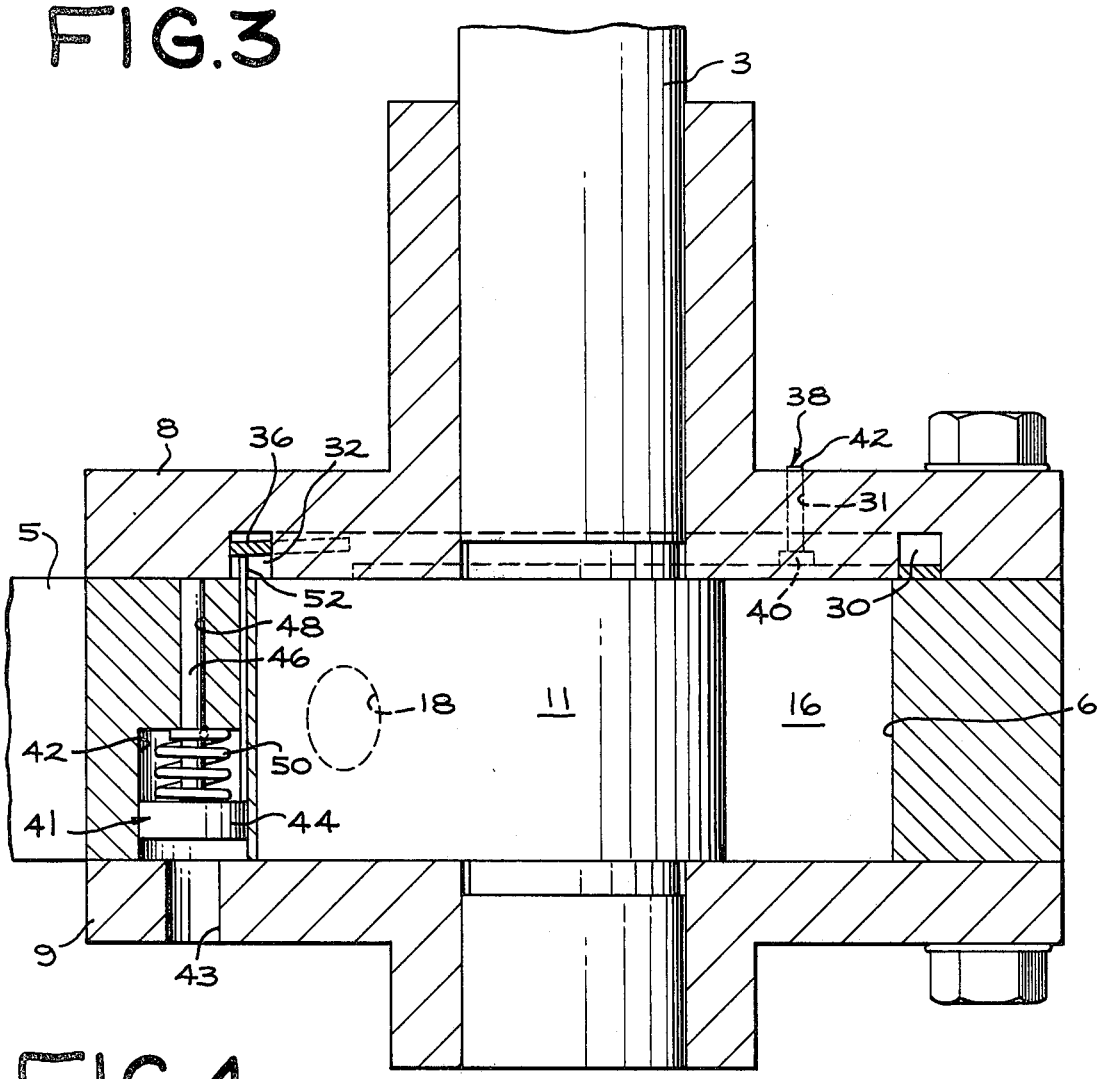
FIG. 3 is a sectional view taken along lines 3—3 of FIG. 2.
Figure 4:
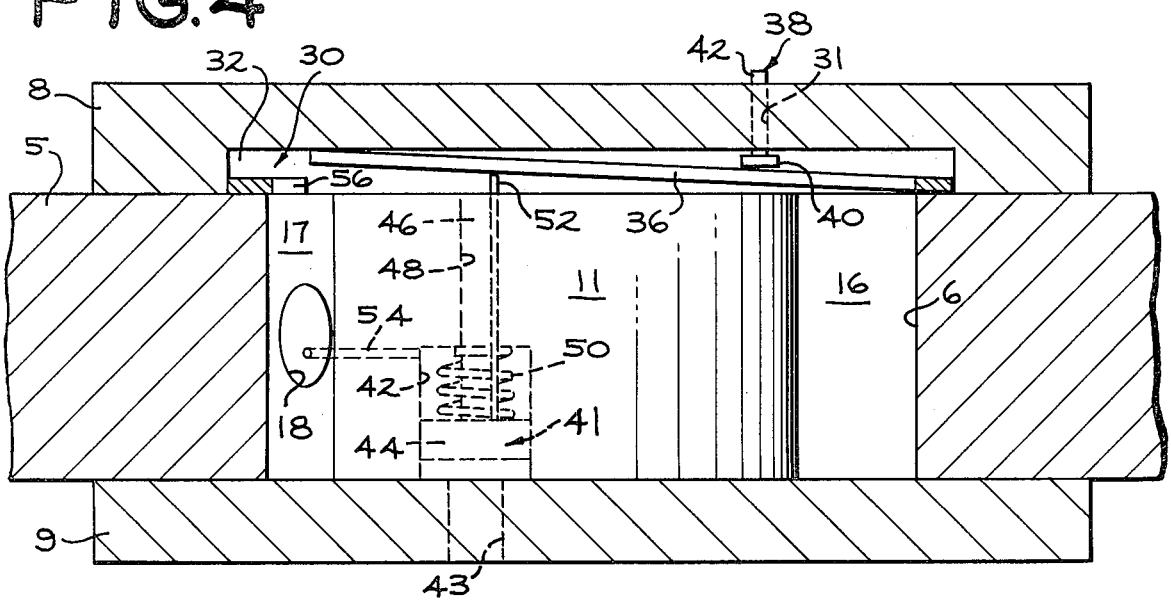
FIG. 4 is a sectional view taken along lines 4—4 of FIG. 2.
Figure 5:
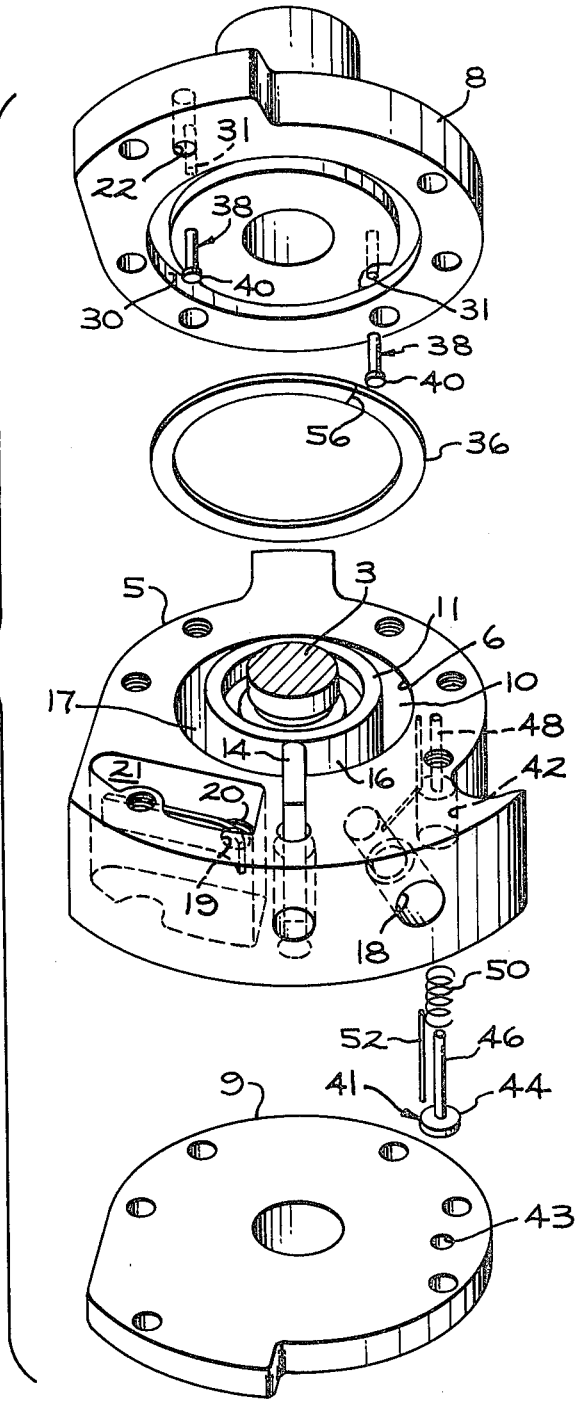
FIG. 5 is an exploded perspective of the compressor showing the parts incorporating one form of the present invention.

The means for operating or lifting valve 36 from its sealed position to the open position shown in FIGS. 3 and 4 includes a piston-like valve operating member 41. The member 41 is arranged in a cylinder or chamber 42 formed in the block 5. The chamber 42 is in communication with the interior of casing 10 through an opening 43 in plate 9. The member 41 includes an enlarged end portion or piston 44 arranged in cylinder 42 and a smaller portion 46 arranged in a guideway 48 that extends upwardly into the block 5. The diameter of opening 43 in plate 9 is smaller than that of cylinder 42 and piston 44 so that the member 41 is maintained in cylinder 42. An actuating pin 52 is slidably arranged in the block 5 so that the lower end thereof engages the upper wall of piston 44 and the upper end extends into channel 30 to engage the lower wall of ring valve 36. A spring 50 is arranged in cylinder 42 in such a manner that piston 44 is maintained in its lowered position against the plate 9 covering the opening 43. With the piston 44 in this position over the opening 43, piston 44 is subjected to the relatively high pressure gas in the casing. A passageway 54 is provided in the cylinder block 5 between the suction port 18 and cylinder 42. The passageway 54 serves to insure that the cylinder side 42 of piston 44 is subjected to refrigerant gas at suction pressure. Since the lower wall of piston 44 adjacent opening 46 is subjected to the high pressure gas present in the casing and the cylinder 42 is subjected to the relatively low suction pressure, it is obvious that as the casing pressure exceeds the suction pressure by a predetermined amount, the piston member 44 moves to the position shown in FIGS. 3 and 4 compressing the spring 50. This upward movement of piston member 44 causes the actuating pin 52 to engage the underside of ring valve 36 and lift it away from the plane or its flush sealing position relative to the lower wall of plate 8 to its open position as shown in FIGS. 3 and 4. The pins 38 are dimensioned so that the pressure exerted thereon is overcome by the same casing pressure exerted on the relatively larger piston 44.

With the ring valve 36 so raised, the high pressure gaseous refrigerant from the compression side of the rotor 11 will enter the passageway 32 exposed to cylinder 10 and be transferred to the suction side of the rotor thereby decreasing the volume of gas in the process of being compressed and, accordingly, decreasing or maintaining the pressure of the discharge gas at or below the peak design load.

In the present instance, the normal operating pressures are considered to be between 760 and 110 PSIG at the suction port and between 280 and 440 PSIG at the discharge port.

The valve means of the present embodiment is designed to modulate the compressor capacity when the discharge pressure exceeds the upper range of pressures. In order to insure a gradual modulating effect or pressure relief between the compression side of rotor to the suction side, the ring valve 36 is provided with a split 56. This split allows a peeling action or deflection of the spring that causes an automatic modulation that varies with the discharge pressure. In effect the valve departs the plane identified as the lower surface of the plate 8 from a position adjacent the split 56 and progressively converges to a closed position at a point in the plane circumferentially toward point "A." The point at which valve 36 is at its closed position or in the plane varies in distance from the split relative to the pressure in the casing. Specifically the greater the pressure in the casing the greater the length of the valve that is moved from the plane and the greater the portion of passage 32 that is opened. The maximum effective open passage is as explained above from the split 56 to point "A."

Figure 6:
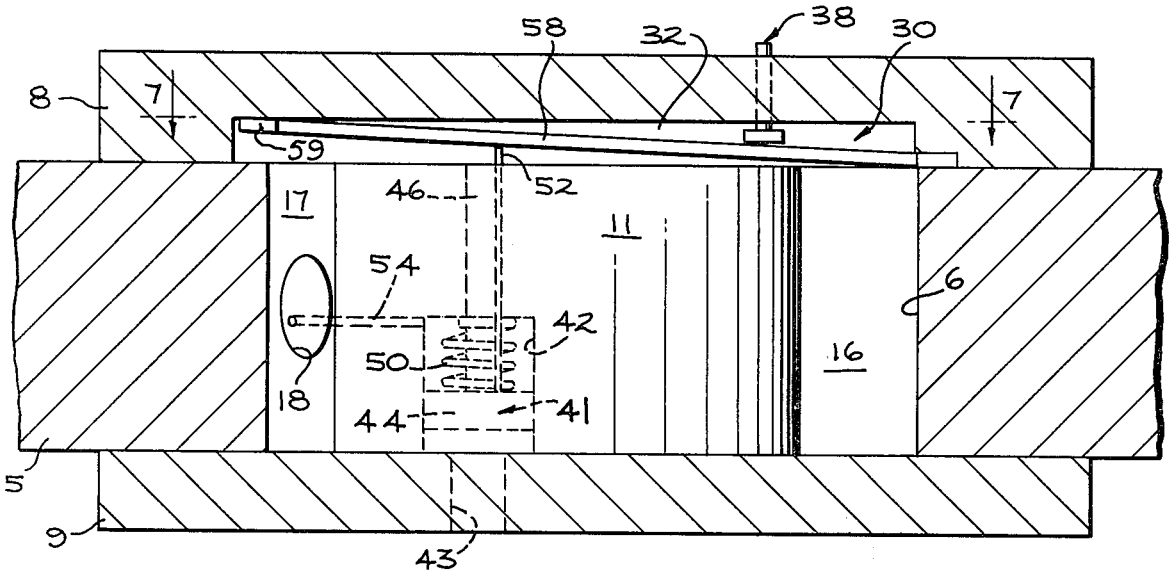
FIG. 6 is a sectional view similar to FIG. 4 showing another embodiment of the present invention.
Figure 7:
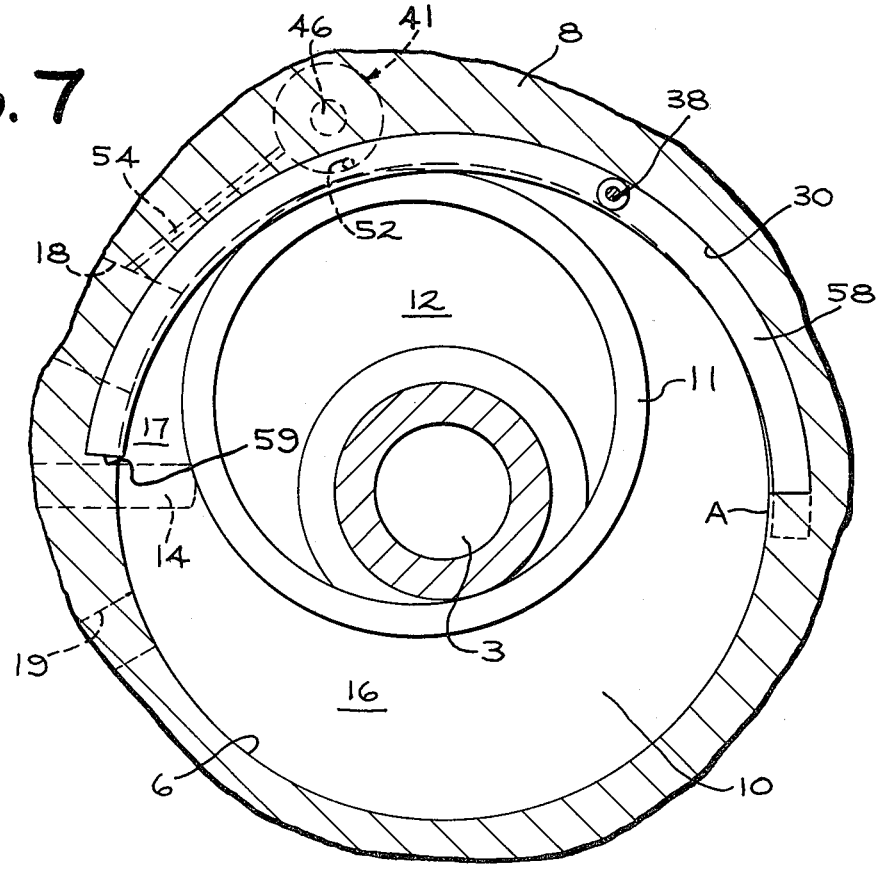
FIG. 7 is a sectional view taken along lines 7—7 of FIG. 6.

Referring now to FIGS. 6 and 7, there is shown another embodiment of the valving arrangement wherein similar parts are indicated by the same numerals as applied in the embodiment shown in FIGS. 1–5.

In this instance, the channel 30 is dimensioned to extend between the area of the vane 14 and point "A" to encompass only that area where refrigerant gas is expected to be transferred between the compression side of the rotor to the suction side of the rotor. Accordingly, the valve 58 in this modification is dimensioned to seal this modified channel dimensioned as shown in FIG. 7. The end of valve 58 adjacent point "A" is trapped between plate 8 and block 5. In this arrangement, the valve 58 opens, as shown in FIG. 6, to permit refrigerant to blend from high side 16 to low side 17. The modulating action of this valve is similar to that shown in FIGS. 1–5; that is, the valve departs the plane at its end 59 and progressively converges to a closed position at a point in the plane circumferentially toward point "A."

The foregoing is a description of the preferred embodiment of the apparatus of the invention and it should be understood that variations may be made thereto without departing from the true spirit of the invention as defined in the appended claims.

What is claimed is:

1. A hermetic rotary refrigerant compressor for use in a refrigeration system including refrigerant condensing means for condensing high pressure gaseous refrigerant from said compressor, an expansion device, and evaporator means wherein liquid refrigerant vaporizes and absorbs heat of evaporization comprising:

a hermetic casing adapted to contain a high pressure refrigerant gas;

a rotary compressor positioned in said casing and comprising means including a cylindrical wall member and upper and lower end plates forming the axial walls of an annular compression cylinder, spaced suction and discharge ports communicating with said cylinder;

means connecting said suction port to the evaporator;

means connecting said discharge port through a discharge valve to said casing;

a rotor extending axially between said plates being eccentrically rotatable within said cylinder with the peripheral surface of said rotor arranged to move progressively into sealing relation with successive portions of said cylindrical wall of said annular cylinder to divide said cylinder between a suction side and a compression side;

a motor having a shaft thereon for driving said rotor within said cylinder;

a radially disposed vane slidably maintained in a slot in said wall member between said ports being biased against said rotor to divide said cylinder into low and high pressure sides within said cylinder;

pressure relief means including channel means formed in one of said end plates, said channel being arranged and dimensioned so that a portion thereof is exposed to said cylinder to form a passageway on said low pressure side of said cylinder;

valve means including a valve in said channel and valve actuating means responsive to discharged refrigerant pressure in said casing being operable for moving said valve from a sealing position flush with the axial wall of said cylinder to an open position in said channel by a force varying with the difference in pressure between the suction and discharge pressures for allowing a portion of said refrigerant being compressed in said cylinder by said rotor to flow through said passageway from the compression side of the peripheral surface of said rotor to the suction side of the peripheral surface of said rotor when the pressure of refrigerant in said casing is greater than a predetermined pressure so that refrigerant pressure at said discharge port is maintained within said predetermined pressure.

2. The hermetic rotary compressor recited in claim 1 wherein in its closed position the wall of said valve facing said cylinder is in a plane defined by the axial wall of said one of said end plates.

3. The hermetic rotary compressor recited in claim 2 wherein said valve in its open position departs the plane from a position adjacent said valve actuating means and progressively converges to a point in the plane that varies in distance from said valve actuating means relative to the pressure in said casing.

4. The hermetic rotary compressor recited in claim 1 wherein said channel is substantially circular extending circumferentially about said cylinder.

5. The hermetic rotary compressor recited in claim 4 wherein said valve means is circular and dimensioned radially to seal against the circumferential walls of said channel.

6. The hermetic rotary compressor recited in claim 1 wherein said valve actuating means further includes a plurality of valve positioning means slidably arranged in said plate each having one end thereof engaging the upper surface of said valve and the other end thereof being exposed to high pressure refrigerant gas in said casing for biasing said valve means in a position flush with the plate wall exposed to said cylinder to seal said passageway from said cylinder.

7. The hermetic rotary compressor recited in claim 6 wherein said valve actuating means further includes a valve operating means arranged in said cylindrical wall member having a portion being larger in area exposed to said casing pressure than said positioning means so that when pressure of said refrigerant gas in said casing is greater than a predetermined amount, said valve operating means causes said valve member to move from its sealing position.

8. The hermetic rotary compressor recited in claim 7 wherein said valve operating means further includes biasing means operable for allowing said valve to remain in said sealing position when the pressure in said casing is within a predetermined range and for yielding when the pressure in said casing is greater than a predetermined pressure to allow said valve operating means to cause said valve to move from its sealing position.

9. The hermetic rotary compressor recited in claim 8 wherein said passageway is in communication with said cylinder substantially between the vane and a point diametrically opposite thereof.

10. The hermetic rotary compressor recited in claim 8 wherein in its closed position the wall of said valve facing said cylinder is in a plane defined by the axial wall of said one of said end plates.

11. The hermetic rotary compressor recited in claim 10 wherein said valve in its open position departs from a position adjacent said vane and progressively converges to a point in the plane that varies in distance from the vane relative to the pressure in said casing.

* * * * *